US006276138B1

(12) United States Patent
Welch

(10) Patent No.: US 6,276,138 B1
(45) Date of Patent: Aug. 21, 2001

(54) ENGINE WITH DIRECT TURBO COMPOUNDING

(75) Inventor: Peter Damien Welch, Harrison Township, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/393,876

(22) Filed: Sep. 10, 1999

(51) Int. Cl.[7] ..... F02D 23/00

(52) U.S. Cl. ..... 60/602; 60/605.1; 60/597; 60/598; 123/198 F; 123/90.16; 123/90.41

(58) Field of Search ..... 60/602, 605.1, 60/597, 598; 123/198 F, 198 DB, 90.16, 90.41

(56) References Cited

U.S. PATENT DOCUMENTS

| | | | | |
|---|---|---|---|---|
| 3,292,364 | * | 12/1966 | Cazier | 60/605.1 |
| 4,255,090 | | 3/1981 | Pratt . | |
| 4,432,430 | | 2/1984 | Lind et al. . | |
| 4,452,208 | | 6/1984 | Merlini et al. | 123/198 F |
| 4,611,465 | * | 9/1986 | Kato et al. | 60/602 |
| 5,540,633 | * | 7/1996 | Yamanaka et al. | 123/198 F |
| 5,653,198 | | 8/1997 | Diggs | 123/90.16 |
| 5,884,603 | * | 3/1999 | Matsuki | 123/198 F |
| 6,092,497 | * | 7/2000 | Preston et al. | 123/198 F |

FOREIGN PATENT DOCUMENTS

405086877A * 4/1993 (JP) ..... 60/597

OTHER PUBLICATIONS

Ward's Engine Update, "Saab Asymmetric Turbo Meant To Hike Torque," Jan. 15, 1999, vol. 25, No. 2, p. 3.

* cited by examiner

*Primary Examiner*—Thomas Denion
*Assistant Examiner*—Thai-Ba Trieu
(74) *Attorney, Agent, or Firm*—Jerome R. Drouillard

(57) ABSTRACT

A multi-cylinder Otto cycle internal combustion direct compound engine for motor vehicles with an exhaust-gas turbocharger providing direct turbo compounding upon the engine control module receiving a speed signal indicating that the vehicle is traveling in a predetermined cruise-speed mode. Upon receipt of the signal the module turns-off each fuel injector feeding a second group of the cylinders, while maintaining fuel injection to a first group of cylinders and fully opening the electronic intake-air induction throttle. As a result the unfired second group of cylinder pistons are driven solely by compressed inlet-air pressure during the time the vehicle travels at or above a predetermined light-load cruising-speed, while positive pumping work occurs in all the cylinders. The engine thus conserves fuel during light load cruising speed while maintaining low pollutant emissions.

10 Claims, 1 Drawing Sheet

ENGINE WITH DIRECT TURBO COMPOUNDING

FIELD OF THE INVENTION

The present invention relates generally to compound internal combustion engines for motor vehicles and particularly, to an engine providing direct turbo compounding of a group of the engine cylinders at light-loads, thereby achieving fuel savings while insuring low pollutants in the exhaust gas.

BACKGROUND OF THE INVENTION

It is well known in the engine art to provide a compound multi-cylinder Otto cycle internal combustion engine which uses an exhaust-gas turbine to achieve additional engine power by some form of coupling to the output shaft. In an exhaust-gas turbocharger two turbo elements, a turbine and a compressor, are installed on a single shaft. A fluid coupling is provided between the engine and the turbocharger by the turbine using the energy of the engine exhaust-gas to drive the compressor. The compressor, in turn, draws in fresh air and, upon having its temperature reduced by an after-cooler, supplies compressed air to assist in driving the fired pistons of the engine cylinders. It is also known to direct a quantity of turbine exhaust-gas energy from the engine and combine it with the inlet airflow for assisting in driving all or a portion of the pistons. The inventor herein has recognized the disadvantages of known compound engines, such as the loss of fuel efficiency and the decrease in air quality.

SUMMARY OF THE INVENTION

A feature of the invention claimed herein is to provide a vehicle internal combustion direct-compound engine equipped with an exhaust-gas turbocharger, wherein improved operating economy is achieved by operating a portion of the engine cylinders solely as air-expanders during light-loads. As used herein, "direct-compounding" is initiated upon the vehicle reaching a predetermined threshold light-load cruising speed, wherein the engine control module is programmed to deactivate the fuel injectors feeding a selected number of engine cylinders, for example one-half of the cylinders. As a result, the selected unfired cylinders operate as air-expanders, driven solely by pressurized intake air from the compressor. Thus, the unfired air-driven cylinders, together with the remaining fired cylinders, power the vehicle during the selected light-load cruise-speed range, such as 45–60 mph for example. Upon the driver allowing the vehicle speed to fall below 45 mph the engine control module is programmed to activate the fuel injectors for the unfired cylinders, wherein all the cylinders are fired for full-load reduced speed range.

Another feature of the invention is to provide an in-line four-cylinder engine wherein a first group of constantly fired cylinders are connected to a first exhaust manifold system and a second group of selectively fired cylinders are connected with a second exhaust manifold system. The first exhaust manifold system has a first catalytic converter for the first group of cylinders and the second exhaust manifold system has a second catalytic converter for the second group of cylinders. The first and second catalytic converters are arranged in a juxtaposed manner whereby the first converter provides maximum heat transfer to the second converter with the vehicle operating in its light-load cruise mode. In the disclosed embodiment the outer shell of the first catalytic converter is of a determined size to enclose the second converter in a heat-sealed manner. As a consequence, the second converter maintains its catalytic material at or above the minimum operating temperature during the cruise-speed mode. Thus applicant's invention insures that the second converter promotes the required chemical reaction with the pollutants in the exhaust gas of the second group of cylinders the instant the vehicle speed falls below the cruise-speed mode, i.e. during full-load operation of the vehicle when all the cylinders are fired.

The invention provides that upon the engine reaching its selected cruise-speed, the control module also actuates the electronic air induction throttle valve to its full open position, maximizing the air flow to the intake manifold, resulting in high inlet boost pressure to both the fired and unfired groups of cylinders.

Another aspect of the invention relates to a dual-event camshaft/rocker arm arrangement adapted to be used in place of a conventional rocker arm assembly controlling the engine cylinder valves associated with the engine second group of cylinders. The dual-event mechanism includes a solenoid, which, upon being energized by the control module, deactivates the exhaust-gas valve system of each of the second group of cylinders during the engine cruise-speed mode. As a result the dual-event camshaft/rocker arm arrangement converts the second group of cylinders from four-cycle to two-cycle air-expanders, thereby further increasing the fuel efficiency of the direct-compound engine.

BRIEF DESCRIPTION OF THE DRAWINGS

Other features and advantages of the invention described herein will be more fully understood by reading examples of the embodiments, in which the invention is used to advantage, referred to herein as the Description of the Preferred Embodiments, with reference to the drawing wherein.

DESCRIPTION OF THE PREFERRED EMBODIMENTS

Figure 1:
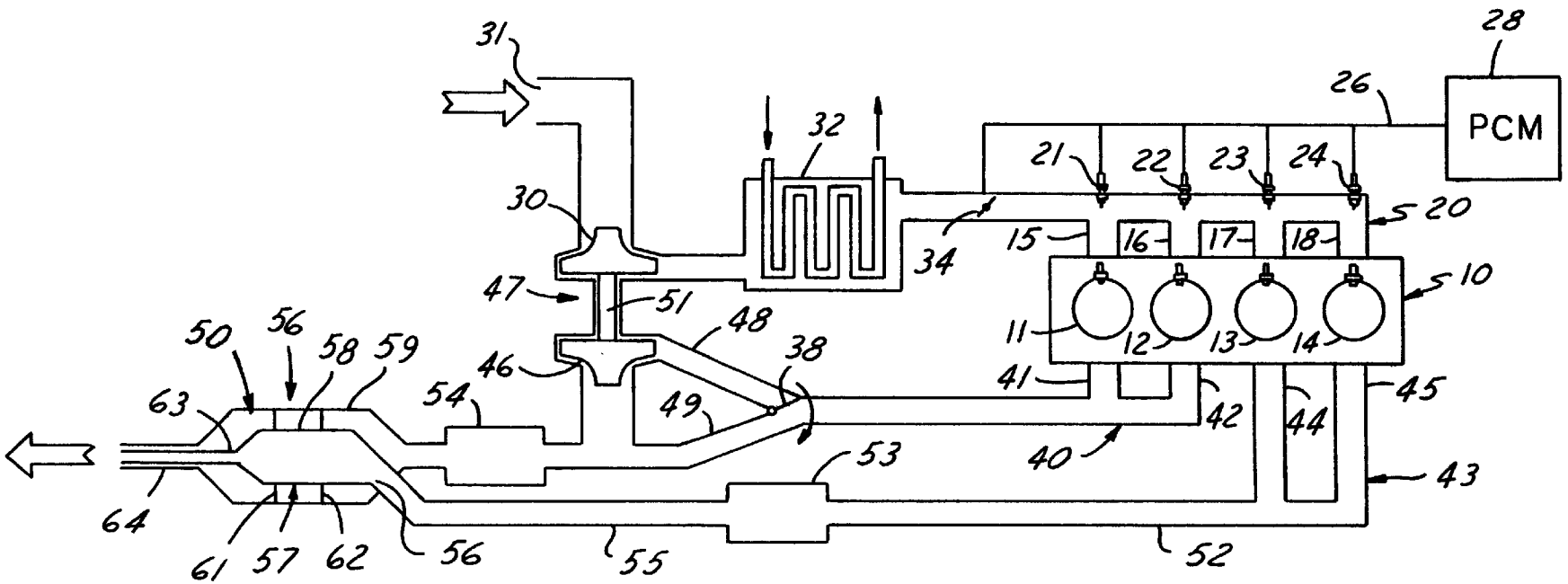
FIG. 1 is a diagrammatic view showing a four-cylinder internal combustion engine, with direct turbo compounding, constructed in accordance with the invention.

The diagrammatic FIG. 1 shows a direct-compounding multi-cylinder Otto-cycle internal combustion engine indicated generally at 10, provided with four inline cylinders, denoted by the reference numerals 11, 12, 13, and 14. Reference numerals 15, 16, 17, and 18 are intake air ducts for the respective cylinders 11–14 that extend from an inlet manifold 20. The engine 10 is fed by injection, with each intake duct 15–18 having an associated electrically operated gasoline fuel injector 21, 22, 23, and 24, respectively. The injectors are actuated by way of conductor 26, operatively connected to an electronic microcomputer unit (not shown) within a power-train control module 28. For a description of a L-Jetronic fuel injection system suitable for the instant invention, reference may be made to pages of Automotive handbook, Published by Robert Bosch GmbH, Fourth Edition), the Pages 468–470.

Upstream of the intake feed manifold 20 there is disposed a centrifugal supercharging compressor 30, operative to increase the pressure of the intake air to the cylinders 11–14. As the intake air enters intake 31, it is compressed its temperature rises, thus reducing the efficiency of turbocharging. The use of a heat exchanger 32 as a charge-air cooler reduces the temperature of the compressed intake air before it enters the cylinders. The air drawn through the inlet feed manifold 20 is controlled by electronic induction throttle valve 34. A conductor 26 connects a microcomputer unit (not shown) of the throttle valve 34 to the power-train control module 28. Details of a typical control module are shown and described on Page 142 of the book: Ford Fuel Injection and Electronic Engine Control, published 1992 by Robert Bentley, Cambridge, Mass.

In the disclosed embodiment a first group of cylinders 11 and 12 are shown connected to a first exhaust-gas manifold 40 by associated ducts 41 and 42, while a second group of cylinders 13 and 14 are connected to a second exhaust-gas manifold 43 by a pair of ducts 44 and 45, respectively.

The four cylinders 11–14 are supercharged by inlet boost pressure from the compressor 30, and the extent of supercharge depends on the throughput of exhaust-gas traversing turbine 46 of a turbocharger assembly, generally indicated at 47. The fired cylinders are regulated by the power-train control module 28 to an ideal fuel mixture for perfect combustion, in accordance with the stoichiometric or the ideal air/fuel ratio for perfect combustion, which for gasoline is approximately 14:1.

If the overpressure in the first exhaust manifold 40 exceeds a given limiting value; the power-train control module microcomputer (not shown) operates a control actuator (not shown) of electronic by-pass valve 38. The by-pass valve 38, as depicted, is in its closed position diverting all the exhaust-gas from the first group of cylinders 11 and 12, via pipe section 49, from the first manifold 40 to a first primary catalytic converter, generally indicated at 50, to be described. Upon moving the by-pass valve 38 to its fully opened position, all the exhaust-gas from the first group of cylinders is directed to the inlet of turbine 46, via pipe section 48. When the by-pass valve 38 is partially closed the exhaust-gas of cylinders 11 and 12 is divided between the turbine 46 and the first catalytic converter 54 by means of pipe sections 48 and 49, respectively.

The exhaust-gas turbocharger 47 consists of two turbo elements, the compressor 30 and the turbine 46, installed on a single rotating shaft 51. The turbine 46 uses the energy of the exhaust-gas of cylinders 11 and 12 to drive the compressor 30, which, in turn, draws in fresh intake air through outside air inlet 31, and supplies the inlet air to the cylinders 11–14 in compressed form. The inlet fresh air and the mass flow of the exhaust gases represent the only coupling between the engine 10 and the compressor 30. The turbocharger speed does not depend on the engine speed, but is rather a function of the balance of drive energy between the turbine and the compressor.

The exhaust-gas from the second group of cylinders 13 and 14 flows from the exhaust manifold 43, through pipe section 52 to a "light-off" catalytic pre-converter 53. An additional "light-off" catalytic pre-converter 54 is provided to receive the exhaust-gas from the pipe section 49, the outlet of which is connected to the first catalytic converter 50. The pre-converters 53 and 54 are designed for fast heating and function to convert pollutants into less harmful substances during the first thirty seconds of engine start-up, i.e. until larger "dual-bed", or the like, primary catalytic converters 50 and 57 are heated by the engine exhaust gases to a predetermined temperature at or above their designed operating temperature.

Pipe section 55 conducts heated exhaust-gas from the pre-converter 53, to an intake 56 of a concentrically disposed, second primary catalytic converter 57 having a cylindrical shell 58. The second primary converter 57 is enclosed, in a sealed manner, by exterior cylindrical shell 59 of the first primary converter 50. It will be noted that the second primary converter 57, retained by a pair of gussets 61 and 62 in the first primary converter outer shell 59, has an exit exhaust pipe 63 concentrically disposed within an outer exhaust pipe 64 of the first primary converter 50. The juxtaposed concentric relationship between the first 50 and second 57 primary converters maintains the heat of the inner primary converter 57 at or above its predetermined operating temperature. This arrangement is necessary because the second group of cylinders 13 and 14 are not fired during travel of the vehicle at its cruise-speed mode. Thus, without applicant's juxtaposed heat transfer arrangement of the primary converters 50 and 57, the compressed and cooled intake air that is exhausted through the second primary converter 57 would, during the vehicle's cruise-speed mode, reduce the temperature of the catalyst of primary converter 57 below its operating temperature.

Upon a vehicle initially reaching a predetermined cruise-speed mode, the direct turbo compound engine control module deactivates each of the injectors 23 and 24, resulting in each second group cylinder 13 and 14,being powered solely by the compressed inlet air received from the inlet manifold 20. At the same time the fuel injectors 23 and 24 are shut-off the control module 28 opens the electronic air induction throttle 34 fully, thus providing maximum inlet air boost pressure to both groups of cylinders. When the control module 28 senses that the vehicle speed has dropped below the predetermined minimum of the cruise-speed mode, the control module activates the fuel injectors 23 and 24, which resume firing the second group of cylinders 13 and 14. In the present embodiment the vehicle cruise-speed mode has a speed range of about 45 to 60 mph.

The invention includes additional means to increase the fuel efficiency of the direct turbo compound engine unfired cylinders 13 and 14 by employing a duel event camshaft/rocker arm mechanism. One example of such a mechanism is shown in U.S. Pat. No. 5,653,198 issued Aug. 5, 1997 to Diggs entitled "Finger Follower Rocker Arm System". The Diggs patent discloses a solenoid operated rocker arm device for deactivating one or more valves for an engine during low engine power to provide fuel economy. By use of such a device in the engine of the present invention the second group of cylinders 13 and 14 are modified by the control module, during the cruise mode, to achieve a pair of two-cycle air expanders.

While the best modes for carrying out the invention have been described in detail, those skilled in the art in which this invention related will recognize various alternative designs and embodiments, including those mentioned above, in practicing the invention that has been defined by the following claims.

I claim:

1. A multi-cylinder Otto cycle direct compound internal combustion engine for a motor vehicle comprising:

a compressor of an exhaust-gas turbocharger draws-in and compresses outside air, for delivery, via an electronic throttle valve and an intake manifold, to first and second groups of engine cylinders;

the first group of cylinders are connected to a first exhaust manifold for delivery of their exhaust-gas to drive a turbine of the turbocharger, via an electronic by-pass valve;

the by-pass valve being operable, by pressure sensing means of a power-train control module, to direct part or all of the exhaust-gas to drive the turbine, and whereby the exhaust-gas from the first group of pistons is exited, through first catalytic converter means, to the atmosphere;

the second group of cylinders are connected to a second exhaust manifold, whereby during the time the second group of cylinders are fired their exhaust-gas is exited, through second catalytic converter means, to the atmosphere; and the control module adapted for regulating a fuel injector for each of the engine cylinders, whereby upon speed sensor means of the control module indicating the vehicle speed has reached a predetermined light-load cruise-speed mode, wherein the control module deactivates each second group cylinder fuel injector, resulting in each second group cylinder being powered solely by compressed air boost pressure, via the intake manifold, such that the engine achieves increased fuel efficiency during operation of the vehicle in the cruising-speed mode.

2. The direct compound engine as recited in claim 1 wherein the first and second catalytic converter means comprising first and second catalytic converters with the first catalytic converter positioned juxtaposed a second catalytic converter, wherein during each time interval that the engine is operated in its cruise-speed mode, resulting in only compressed intake air flowing through the second catalytic converter, such that sufficient heat transfer occurs from the first converter to the second converter thereby maintaining the second converter at or above its predetermined operating temperature; and upon the vehicle speed falling below the cruise-speed mode, speed sensor means of the control module activates each second group fuel injector, whereby the second catalytic converter is adapted to immediately convert pollutants in the exhaust-gas flow from the second group cylinders to less harmful substances, by virtue of maintaining the second converter at or above its operating temperature during the vehicle's light-load cruise-speed mode.

3. The direct compound engine as recited in claim 2 wherein the first and second primary catalytic converters each having an outer metal casing enclosing its associated catalyst materials, and wherein the first converter outer casing of a predetermined size such that it encloses the second converter outer casing, thereby providing maximum heat transfer from the first converter to the second converter during operation of the vehicle in its cruise-speed mode.

4. The direct compound engine as recited in claim 3 wherein the first and second catalytic converters each have a cylindrical outer metal casing, and wherein the first converter outer casing is concentrically disposed about the second converter outer casing, thereby minimizing the space occupied by the first and second converters.

5. The direct compound engine as recited in claim 1 wherein the engine is an in-line four-cylinder engine, and wherein a first pair of adjacent cylinders comprise the first group of cylinders and a second pair of adjacent cylinders comprise the second group of cylinders.

6. The direct compound engine as recited in claim 1 wherein the engine is provided with dual-event camshaft/rocker arm means, such that during the light-load cruise-speed mode the operation of the second group of cylinders is converted from four-cycle air expanders to two-cycle air expanders thereby increasing the fuel efficiency of the engine during the cruise-speed mode.

7. A method for increasing the fuel economy of a vehicle internal combustion direct compound engine operated by a power-train control module, the engine provided with an exhaust-gas turbocharger having turbine and compressor elements located on a common shaft, and wherein first and second groups of engine cylinders are each supplied fuel by an associated fuel injector, the method comprising:

expelling exhaust-gas from the first group of fired cylinders, via a first exhaust manifold, to drive the turbine by means of the engine exhaust gas, via a first exhaust manifold, and directing the exhaust-gas from the first group of cylinders through first catalytic converter means;

sensing a predetermined vehicle light-load cruise-speed by the power-train control module, wherein the fuel injector of each second group cylinder is deactivated;

drawing in fresh intake air by a compressor of the turbocharger for supply, in compressed form, to drive each second group unfired cylinder, whereby each second group cylinder is powered solely by compressed intake-air during operation of the vehicle in a light-load cruise-speed mode;

expelling exhaust-gas by the fired second group of cylinders, via a second exhaust manifold, for flow through a second catalytic converter means, during operation of the vehicle in a speed range below its cruise-speed range, wherein the fuel injector of each second group cylinder is activated;

expelling intake-air by the unfired second group of cylinders, via a second exhaust manifold, for flow through second catalytic converter means, during operation of the vehicle in its predetermined light-load cruise-speed mode; and applying heat to the second converter means during the cruise speed mode, thereby maintaining the second converter means at or above its predetermined operating temperature, whereby the second converter means is operative to immediately convert pollutants in the exhaust-gas, delivered to the second converter means from the second group of cylinders, into less harmful substances.

8. The method recited in claim 7 wherein the first and second catalytic converter means are in the form of first and second juxtaposed catalytic converters that sufficient heat is transferred from the first converter to the second converter during the cruise-speed mode, thereby maintaining the second converter at or above its predetermined operating temperature.

9. The method recited in claim 8 wherein the first converter surrounds the second catalytic converter in a sealed manner to provide maximum heat transfer from the first converter to the second converter.

10. The method recited in claim 7 wherein converting the second group of unfired cylinders from four-cycle operation to two-cycle operation by installing a dual-event camshaft/rocker arm, thereby increasing engine fuel efficiency during the cruise speed mode.

* * * * *